United States Patent [19]

Cummins

[11] Patent Number: 4,486,112

[45] Date of Patent: Dec. 4, 1984

[54] LOOSE LEAF BINDER

[75] Inventor: Richard D. Cummins, Orchard Park, N.Y.

[73] Assignee: R. D. Cummins, Incorporated, Buffalo, N.Y.

[21] Appl. No.: 354,537

[22] Filed: Mar. 4, 1982

[51] Int. Cl.[3] ..... B42F 3/04; B42F 13/20; B42F 13/02; B42F 3/00

[52] U.S. Cl. ..... 402/34; 402/41; 402/42; 402/46; 402/55

[58] Field of Search ..... 402/29, 30, 31, 34, 402/35, 36, 41, 42, 80, 46, 55

[56] References Cited

U.S. PATENT DOCUMENTS

| | | | |
|---|---|---|---|
| 760,848 | 5/1904 | Carney et al. . | |
| 782,986 | 2/1905 | Phoenix . | |
| 794,290 | 7/1905 | Ford | 402/34 |
| 796,759 | 8/1905 | Phillips et al. . | |
| 801,208 | 10/1905 | Boden . | |
| 804,599 | 11/1905 | Harn . | |
| 818,548 | 4/1906 | McNeal | 402/41 |
| 924,647 | 6/1909 | Eddy . | |
| 974,831 | 11/1910 | Scherzinger . | |
| 1,097,391 | 5/1914 | Couch | 402/41 |
| 1,398,388 | 11/1921 | Murphy . | |
| 1,439,367 | 12/1922 | Krag | 402/41 |
| 2.013.416 | 10/1935 | McClure | 129/24 |
| 2,075,766 | 8/1936 | Rand | 129/13 |
| 2,089,211 | 8/1937 | Krag | 402/41 |
| 2,368,729 | 8/1943 | Schade | 129/24 |
| 2,386,024 | 3/1944 | Williams | 129/24 |
| 2,648,338 | 2/1951 | Minkoff | 129/24 |
| 3,153,417 | 10/1964 | Newman | 129/24 |
| 3,205,895 | 9/1965 | Johnson | 129/24 |
| 3,255,759 | 6/1966 | Dennis | 402/34 |
| 3,280,821 | 10/1966 | Dougherty | 402/42 |
| 4,130,368 | 12/1978 | Jacoby et al. | 402/41 |
| 4,349,289 | 9/1982 | Cardellini | 402/34 |
| 4,355,916 | 10/1982 | Cardellini | 402/41 |

*Primary Examiner*—Robert L. Spruill
*Assistant Examiner*—Paul M. Heyrana, Sr.
*Attorney, Agent, or Firm*—Bean, Kauffman & Bean

[57] ABSTRACT

A loose leaf binder is formed from three parts assembled in a manner providing a binder of minimum thickness.

33 Claims, 16 Drawing Figures

Fig. 2.
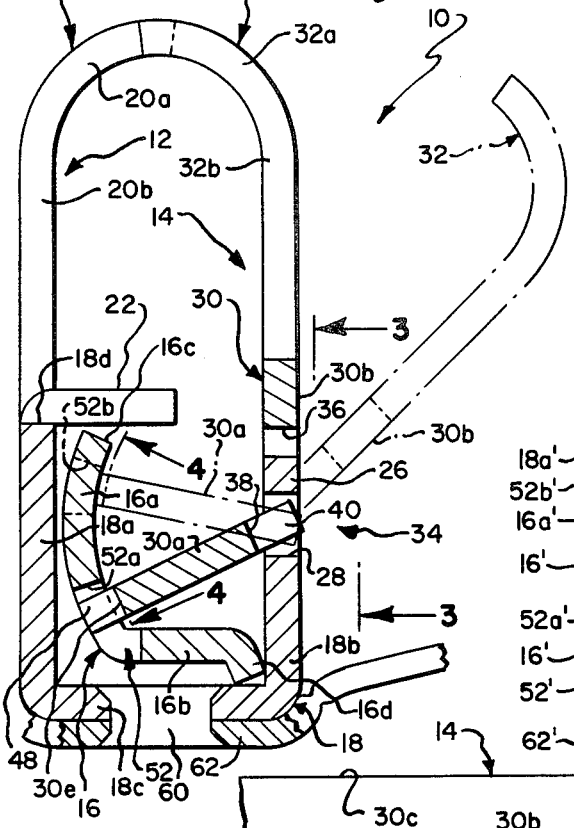
Fig. 6.
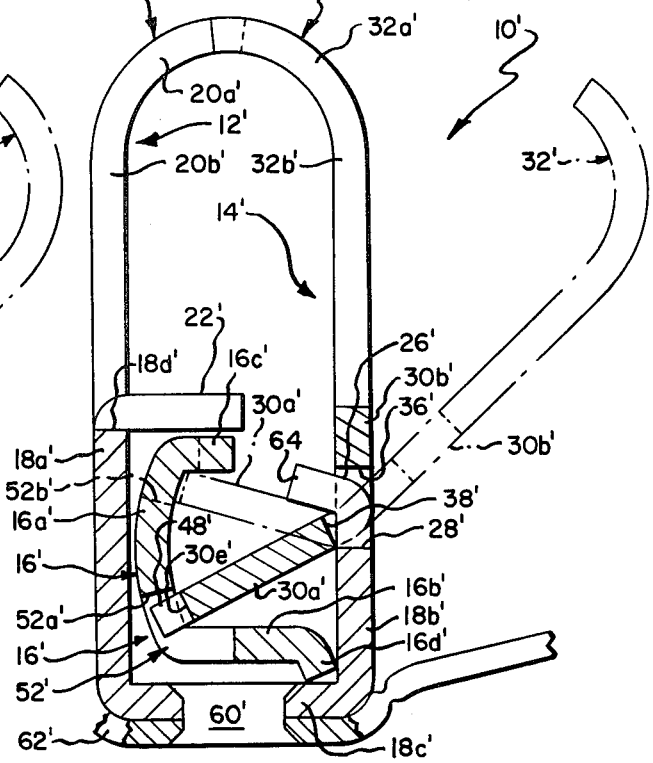
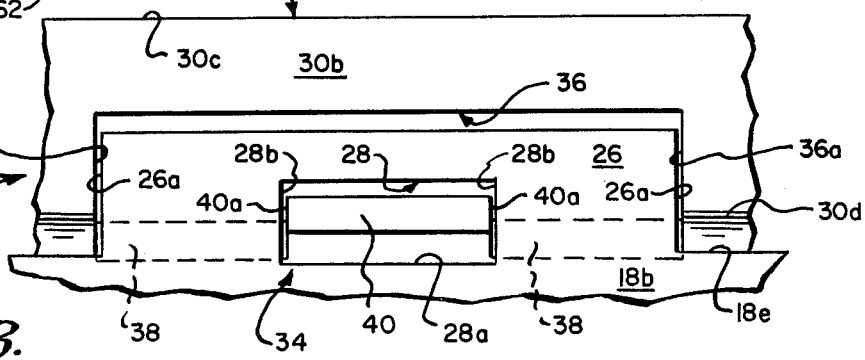
Fig. 3.
Fig. 4.
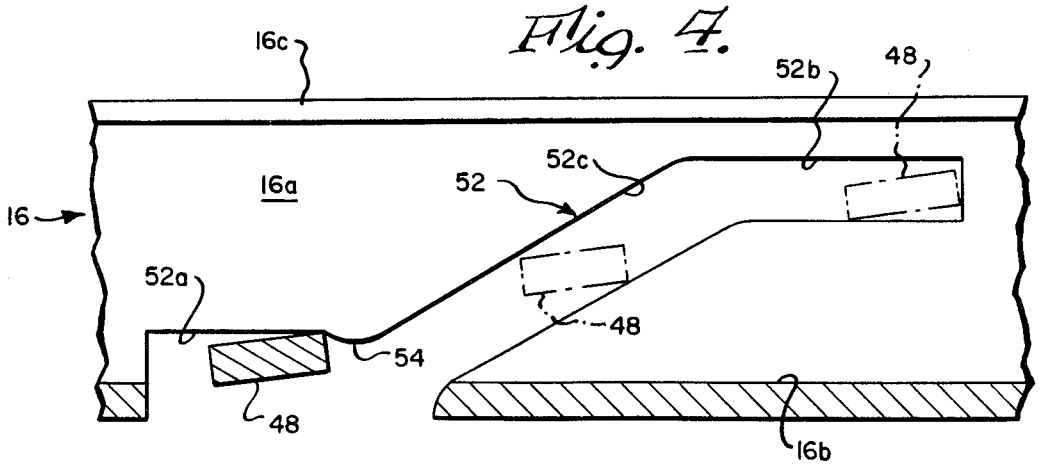

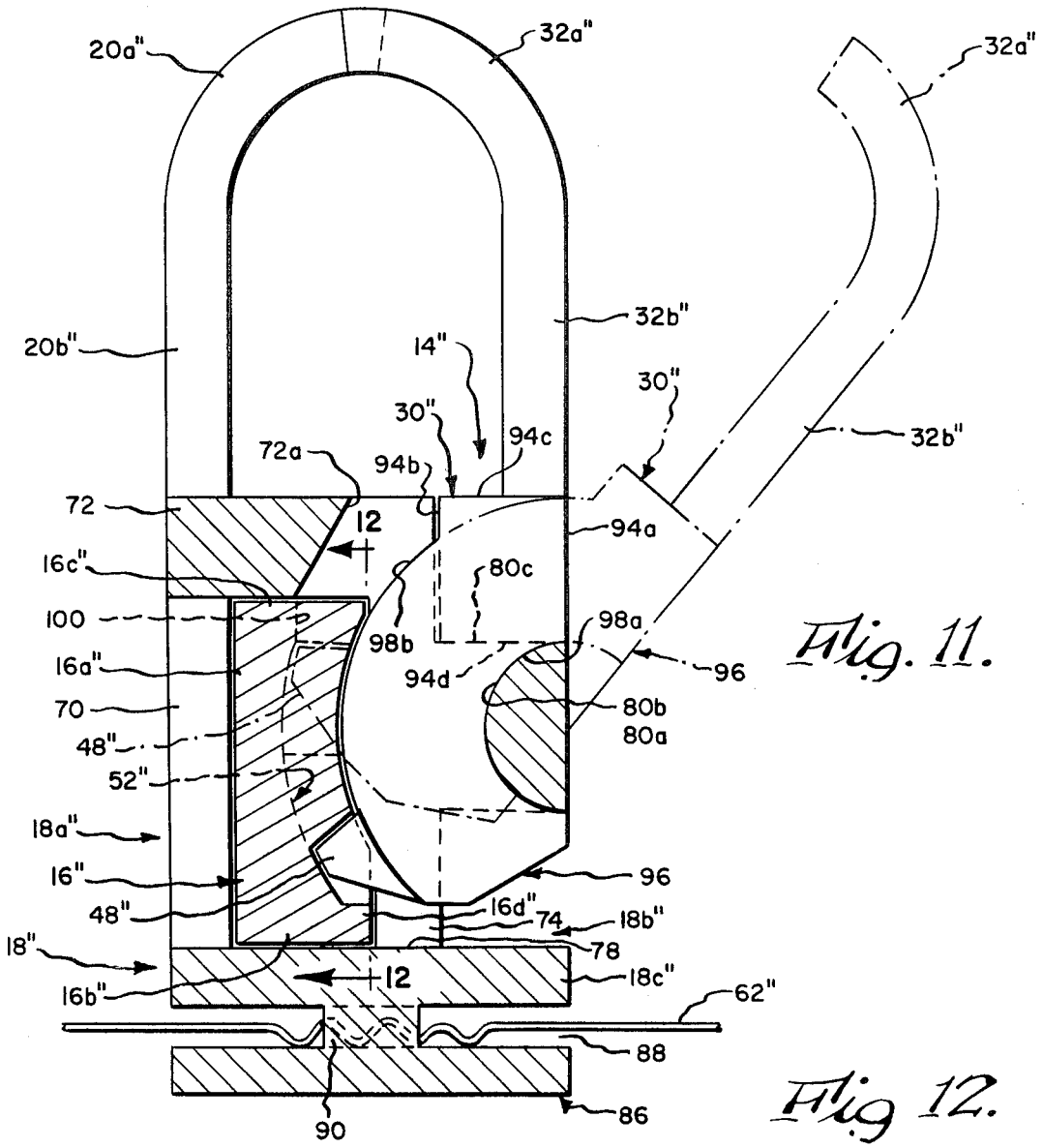
Fig. 11.
Fig 12.
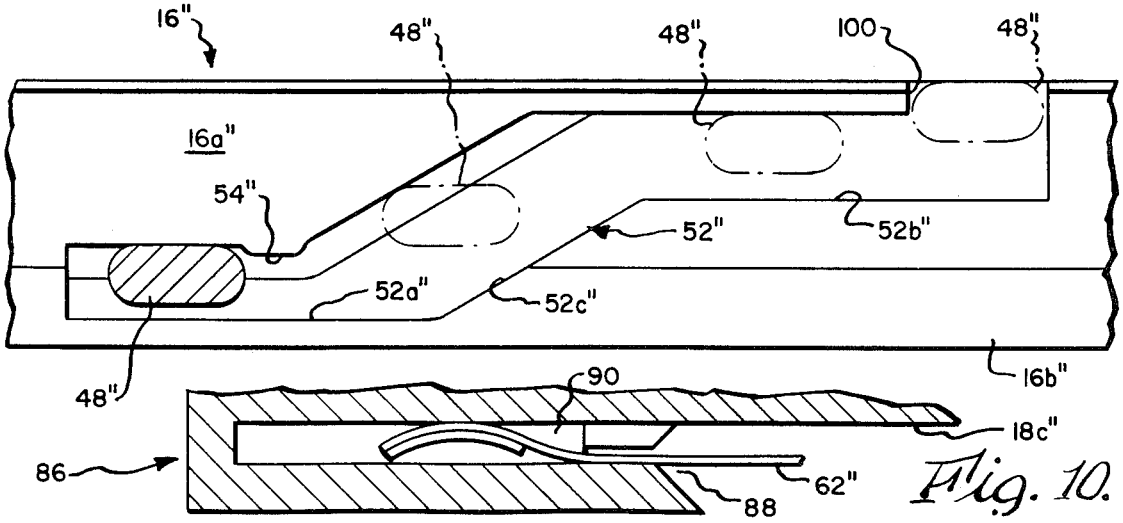
Fig. 10.

Fig. 13.
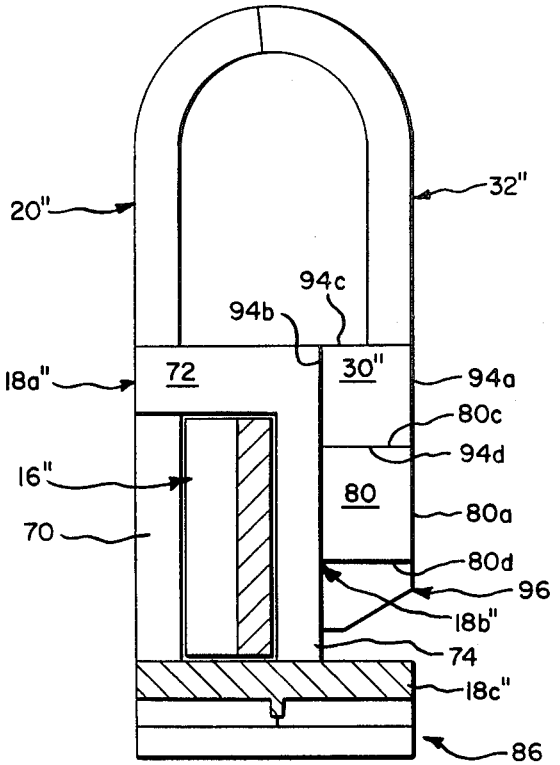
Fig. 14.
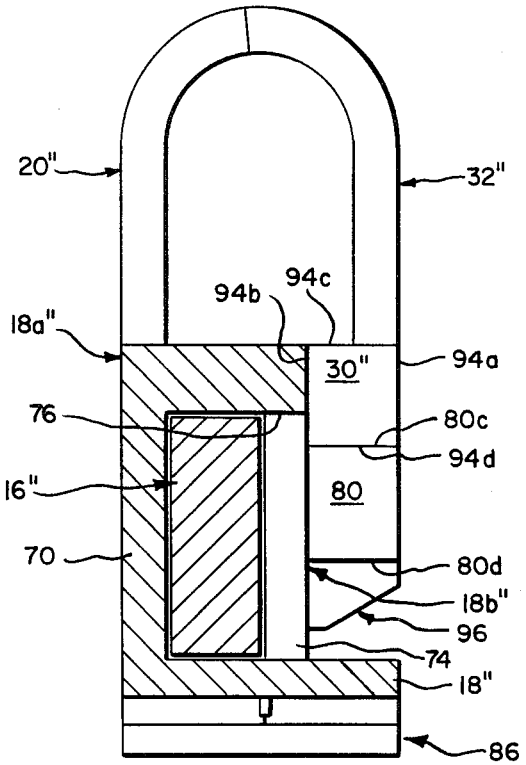
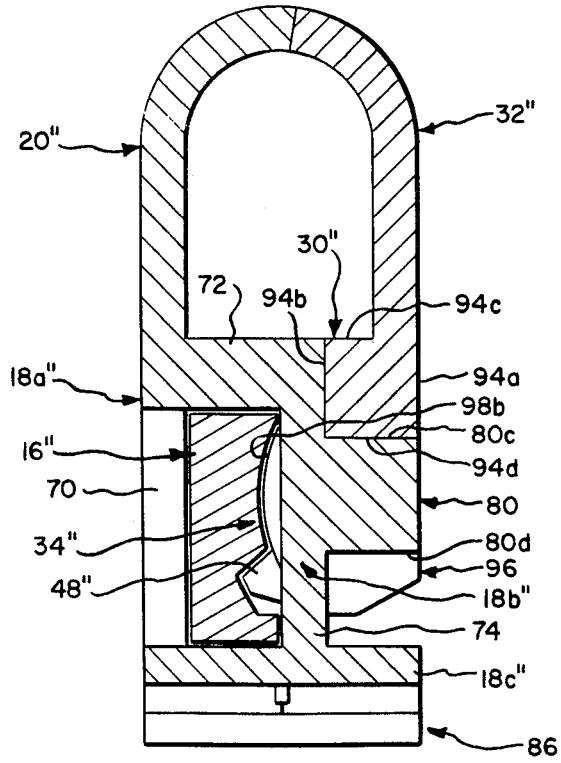
Fig. 15.
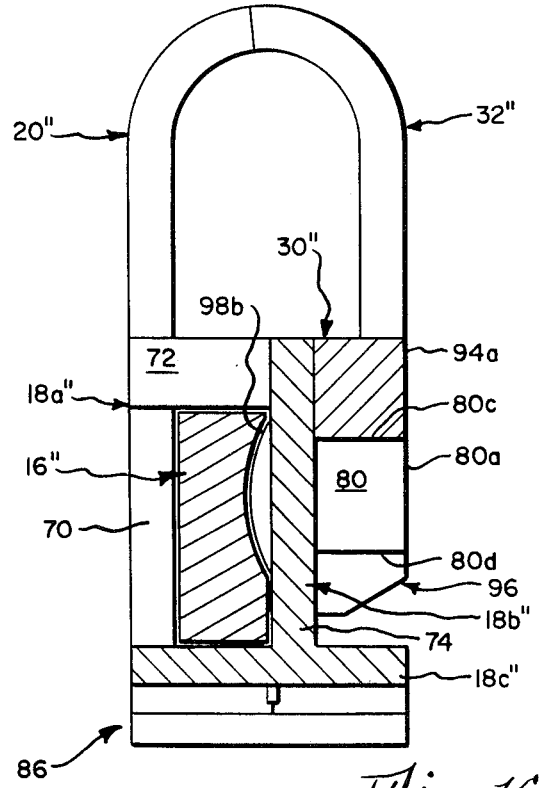
Fig. 16.

LOOSE LEAF BINDER

BACKGROUND OF THE INVENTION

The present invention is directed towards loose leaf binders and more particularly to improvements in binders of the type employing an operating slide to effect relative pivotal movement of claw or ring halves between closed positions in which loose leaves or pages will be retained thereon and open positions in which such leaves or pages may be selectively removed therefrom.

Prior loose leaf binder constructions of which I am aware result in binders of substantial thickness, and thus, are not amenable for use in the separate storage of large numbers of individual loose leaf files in a confined shelf or drawer space. This is a critical drawback in those instances, where it is not convenient or acceptable for filing purposes to place more than one individual file in the same or common binder, and such individual files normally comprise a limited number of leaves or pages.

SUMMARY OF THE INVENTION

The present invention is directed towards an improved loose leaf binder construction, which permits fabrication of binders of substantially less thickness than heretofore possible.

In accordance with the present invention, a binder of three part construction is disclosed as comprising a stationary frame including a base and stationary first claw or ring halves having mounting ends thereof formed integrally with a first side portion of the base; a gate including movable second claw or ring halves having mounting ends thereof formed integrally with a common connecting portion, which is in turn pivotally supported by a second or opposite side portion of the base; and an operating slide positionally located within the base intermediate the side portions thereof and coupled with the gate connecting portion for purposes of effecting controlled pivotal movements of the movable or second claw halves between closed and open positions. When the present binder is in closed condition, the first and second claw halves have their free ends arranged to meet in an overlying relationship relative to the base and their mounting ends disposed to lie in an essentially coplanar relationship with the first and second side portions of the base, respectively, such that the base defines the maximum transverse thickness of the binder.

DRAWINGS

The nature and mode of operation of the present invention will now be more fully described in the following detailed description taken with the accompanying drawings wherein:

FIG. 2 is a sectional view taken transversely through the binder of FIG. 1 when in assembled condition;

FIG. 3 is a sectional view taken generally along the line 3—3 in FIG. 2;

FIG. 4 is a sectional view taken generally along the line 4—4 in FIG. 2;

FIG. 6 is a sectional view taken transversely through the binder of FIG. 5 when in assembled condition;

FIG. 10 is a sectional view taken generally along the line line 10—10 in FIG. 9;

FIG. 11 is a sectional view taken generally along the line 11—11 in FIG. 8;

FIG. 12 is a sectional view taken generally along the line 12—12 in FIG. 11;

FIG. 13 is a sectional view taken generally along the line 13—13 in FIG. 8;

FIG. 14 is a sectional view taken generally along the line 14—14 in FIG. 8;

FIG. 15 is a sectional view taken generally along the line 15—15 in FIG. 8; and FIG. 16 is a sectional view taken generally along the line 16—16 in FIG. 8.

DETAILED DESCRIPTION

Figure 1:
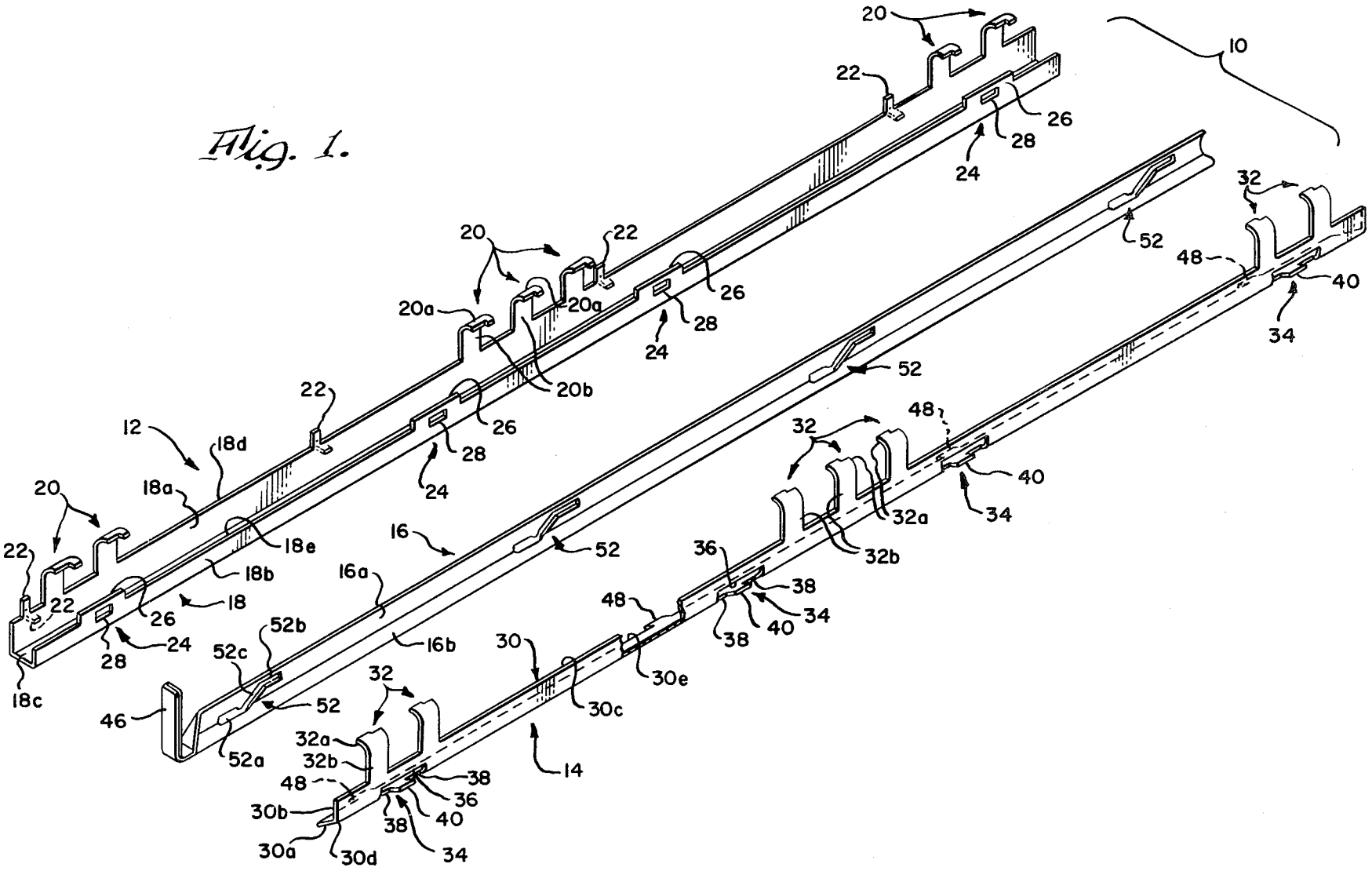
FIG. 1 is an exploded perspective view of a preferred construction, when the binder of the present invention is to be fabricated from stamped metal parts.

Reference is first made particularly to FIGS. 1 and 2, wherein a binder formed in accordance with a preferred form of the present invention is generally designated as 10 and shown as being fabricated from three stamped metal parts comprising a stationary frame 12; a gate 14; and an operating slide 16.

Frame 12 includes an elongated and preferably integrally formed base 18 having first and second base side portions **18*a* and 18*b* and a base connecting portion 18*c*; and a plurality of stationary ring or claw halves 20, which are preferably formed integrally with side portion 18*a*. Side portions 18*a* and 18*b* are shown in FIGS. 1 and 2 as being defined by a pair of planar leg flanges, which are arranged to upstand in an essentially parallel relationship from adjacent opposite, lengthwise extending marginal edges of planar connecting portion 18*c*, such that base 18 assumes a generally U-shaped cross-sectional configuration. Claw halves 20 are preferably of a generally J-shaped configuration and defined by curved free end portions 20*a* and relatively straight or flat mounting end portions 20*b* arranged to project from the upper or free lengthwise extending marginal edge 18*d* of first side portion 18i a and to lie in essentially coplanar relationship with the first side portion. The structure of frame 12 is completed by providing first side portion 18*a* with at least one and preferably a plurality of integrally formed assembly tabs 22, which as initially formed project from and lie in essentially coplanar relationship therewith, as shown in full line in FIG. 1; and by providing second side portion 18*b* with stationary hinge means, such as may be defined by a plurality of integrally formed, stationary hinge parts generally designated as 24. In the construction illustrated in FIGS. 1–4, hinge parts 24 each include a mounting tab 26, which projects from an upper or free lengthwise extending marginal edge 18*e* and lies in an essentially coplanar relationship with the second side portion 18*b*; and a generally rectangular hinge slot 28, which is formed in the mounting tab and arranged such that its relatively lower edge surface 28*a* is arranged to lie in proximate alignment with the upper edge 18*e*, as best shown in FIGS. 1 and 3**.

Gate 14 is shown in FIGS. 1–3 as generally including an elongated gate connecting portion 30, which is defined by angularly related first and second flange portions 30*a* and 30*b;* and a plurality of movable or second claw or ring halves 32, which are preferably of a J-shaped configuration and defined by curved free end portions 32*a* and relatively straight or flat mounting end portions 32*b* arranged to project from the upper or free lengthwise extending marginal edge 30*c* of flange portion 30*b* and to lie in essentially coplanar relationship with such flange portion. Gate connecting portion 30 is stamped or otherwise formed to define a plurality of integrally formed, movable hinge parts, which are generally designated as 34 and arranged to cooperate one with each of hinge parts 24 to support gate 14 on second side portion 18*b* for movement between the binder closed and open positions shown in full and broken line in FIG. 2, wherein claw end portions 32*a* are disposed adjacent to and remotely of claw end portions 20*a*, respectively. Hinge parts 34 each include a generally rectangular clearance opening 36, which is formed in second flange portion 30*b* adjacent its juncture 30*d* with first flange portion 30*a* and sized to freely receive an associated mounting tab 26, as best shown in FIG. 3, in order to permit second flange portion 30*b* to lie in an essentially coplanar relationship with both mounting tab 26 and second side portion 18*b* when gate 14 is in closed position, as best shown in full line in FIG. 2. Each of hinge parts 34 additionally includes a bearing edge surface 38, which is defined by first flange portion 30*a* intermediate opposite side edges 36*a*, 36*a* of clearance opening 36; and a hinge tab 40, which projects essentially centrally from bearing edge surface 38 in an essentially coplanar relationship with first flange portion 30*a* and is sized for receipt within hinge slot 28. Preferably, clearance opening 36 and hinge tab 40 are formed by a punching operation performed on gate connecting portion 30, before first and second flange portions 30*a* and 30*b* are bent along their juncture or fold line 30*d* to assume their final angular relationship shown in FIGS. 1 and 2. Thus, when the first and second flange portions are subsequently bent along line 30*d*, the lower boundary of the as formed opening 36 becomes bearing edge surface 38 and hinge tab 40; the latter remaining in a coplanar relationship with first flange portion 30*a* after completion of the bending operation.

It will be understood by referring to FIG. 3 that the positioning of opposite side edges 36*a* and 36*a* of clearance opening 36 adjacent the opposite side edges 26*a* and 26*a* of mounting tab 26 and/or the positioning of opposite side edges 40*a* and 40*a* of hinge tab 40 adjacent the opposite side edges 28*b* and 28*b* of hinge slot 28 may be employed to limit lengthwise movements of gate 14 relative to frame 12 and thus maintain associated claw halves 20 and 32 in an essentially aligned or facing relationship during movements of claw halves 32 between their closed and open positions. Preferably, as is conventional, claw free end portions 20*a* and 32*a* are shaped to interfit one with the other, so as not to present a straight line of separation when the claws are in closed position. Also, it will be understood by making reference to FIGS. 2 and 3 that bearing edge surface 38 is arranged to engage the relatively inner surface of mounting tab 26 to provide a loose fulcrum about which gate 14 swings or pivots between its closed and open positions.

Operating slide member 16 is best shown in FIG. 1 as being defined by integrally formed, elongated cam and base portions or flange members 16*a* and 16*b*, which may be deformed adjacent one end thereof so as to create an upstanding push-pull tab or member 46 conveniently sized to permit it to be gripped by an operator of binder 12 for purposes of effecting oppositely directed sliding movements of the slide member lengthwise within base 18.

Suitable cam and cam follower means are provided for coupling gate 14 with slide member 16, such that pivotal opening and closing movements are imparted to the gate incident to sliding movements of the slide member. Preferably, such means includes a plurality of cam follower tabs 48, which are spaced apart lengthwise of first flange portion 30*a* and project therefrom beyond its free edge surface 30*e*, which is in turn disposed essentially parallel with bearing edge surfaces 38; and a plurality of cam slots 52, which are formed in cam portion 16*a* and adapted to slidably receive associated ones of follower tabs 48. Cam slots 52 are best shown in FIG. 4 as having lower and upper slot portions 52*a* and 52*b*, which are disposed in an essentially parallel relationship and extend lengthwise of slide member 16, and an inclined connecting or operating slot portion 52*c*, which joins adjacent ends of the lower and upper slot portions. As will be apparent from viewing FIGS. 2 and 4, follower tabs 48 cooperate with lower and upper slot portions 52*a* and 52*b* to retain gate 14 in its closed and open positions, respectively, and with connecting slot portions 52*c* in order to effect pivotal movements of the gate between its closed and open positions. Preferably, cam portion 16*a* is provided with at least one detent 54, which projects within one of lower slot portions 52*a* adjacent its juncture with connecting slot portion 52*c* and serves to define a stop tending to prevent unintentional displacement of follower tab 48 from within lower slot portion 52*a*. Also, it is preferable to slightly bend follower tabs 48 relative to the plane of first flange portion 30*a*, such that they ride with only their edges arranged for sliding engagement with the bounding surfaces of their associated cam slots, as shown in FIG. 4.

By again viewing FIG. 2, it will be understood that binder 10 may be assembled by a simple three step procedure including inserting follower tabs 48 within their associated cam slots 52; placing the thus assembled gate 14 and slide member 16 within base 18, while inserting hinge tab 40 within hinge slot 28; and finally bending assembly tabs 22 downwardly into the positions shown in FIG. 2 and in broken line in FIG. 1. When binder 10 is in its assembled condition, engagement of bearing edge surfaces 38 with the inner surfaces of mounting tabs 26 and engagement of free edge surface 30*e* with the concave or inner surface of cam portion 16*a* serves to maintain hinge tabs 40 within hinge slots 28 and follower tabs 48 within cam slots 52 and thus to positionally locate operating slide 16 within base portion 18. With slide member 16 located in this manner, cam portion 16*a* is arranged such that its convex or outer surface and its free edge portion 16*c* are disposed for sliding engagement with the inner surface of first side portion 18*a* and the lower surfaces of assembly tabs 22, respectively; and free edge portion 16*d* of base portion 16*b* is arranged for sliding engagement with the inner surfaces of second side portion 18*b* and base connecting portion 18*c*. Preferably, free edge 16*d* of base flange member 16*b* is bent downwardly in the manner shown in FIG. 2 for receipt within the inside corner or the juncture defined by portions 18*b* and 18*c* in order to provide clearance between remaining portions of base flange member 16*b* and connecting portion 18*c* or discontinuities on its inner surface, such as may be produced by the heads of rivets 60 employed to attach binder 10 to a suitable cover 62.

The above described construction has the advantages of simplicity of manufacture and its adaptability for use in forming extremely thin loose leaf binders having thicknesses on the order of about one-quarter inch, as measured between the outer or oppositely facing surfaces of base side portions 18*a* and 18*b*, which define the maximum widthwise dimension of the binder.

Figure 5:
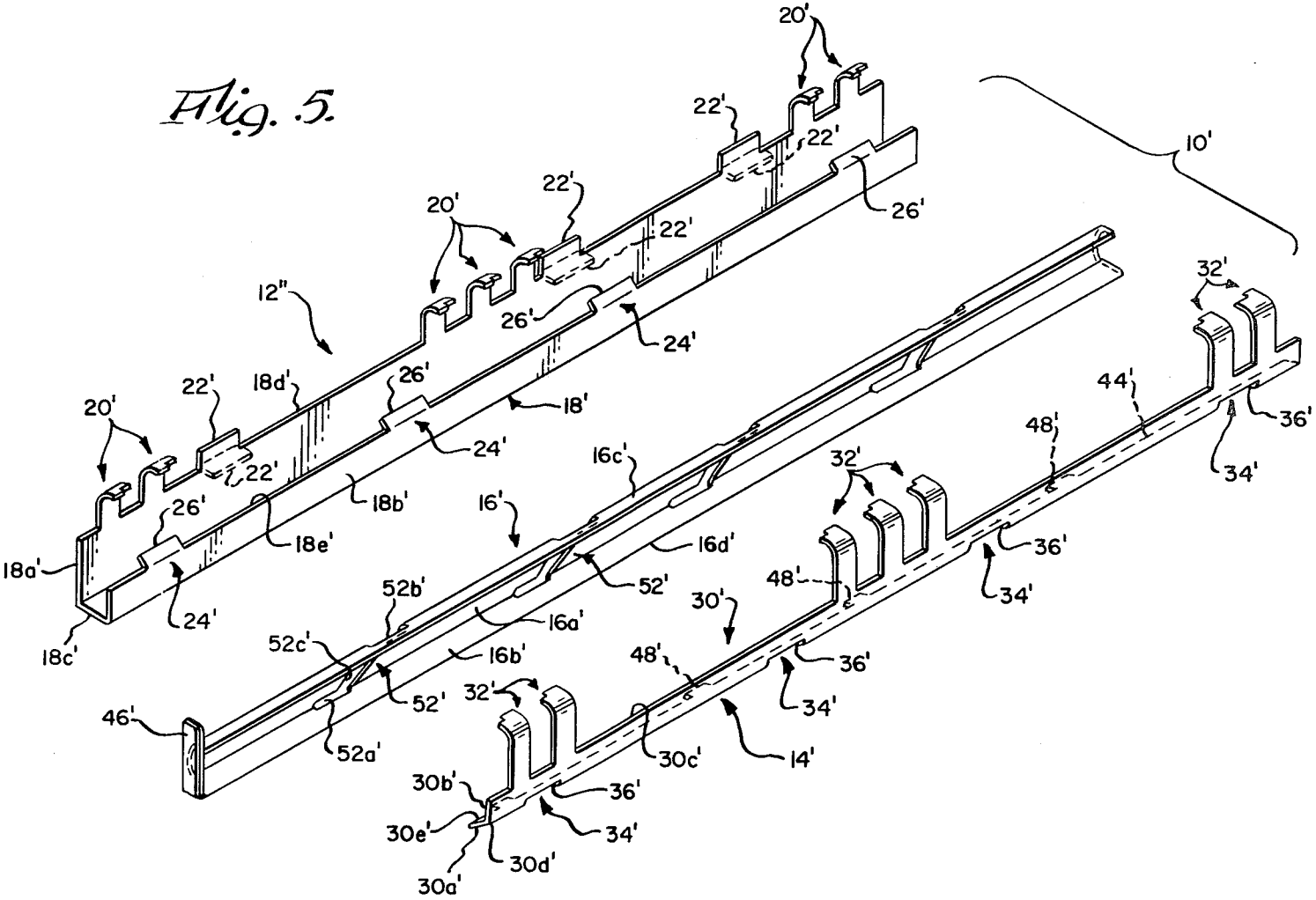
FIG. 5 is an exploded perspective view similar to FIG. 1, but showing an alternative form of binder fabricated from stamped metal parts.

An alternative form of the binder of the present invention is shown in FIGS. 5 and 6, wherein elements of such binder, which correspond to elements of binder 10, are designated by like primed numbers. Binder 10' principally differs from binder 10 in regard to the construction of stationary hinge parts 24' and movable hinge parts 34'. More specifically, hinge parts 24' are each defined by a mounting tab 26', which projects upwardly from adjacent the free or upper edge 18*d'* of second side portion 18*b'* and has its free or upper end 64 bent inwardly to overlie connecting portion 18*c'*, as best shown in FIG. 6; and hinge parts 34' are each defined by a generally rectangular clearance,opening 36', which is formed in second flange portion 30*b'* adjacent its juncture with first flange portion 30*a'* and sized to freely receive an associated mounting tab 26', as is also best shown in FIG. 6. In this construction, the upper end 64 of mounting tab 26' projects inwardly through opening 36' to define a stop or abutment against which first flange portion 30*a'* engages to define the open position of gate 14', as shown in broken line in FIG. 2; and bearing edge surface 38' engages with the lower inner surface of mounting tab 26' to define a fulcrum about which gate 14' pivots between its open and closed positions. Further, it will be noted that the outer surface of second portion 30*b'* is disposed to lie in an essentially coplanar relationship to the outer surface of second side portion 18*b'*, when gate 14' is in its closed condition, such that the maximum widthwise dimension of binder 10' in closed condition is determined by the width of base 18'.

Reference is now made to FIGS. 7 through 16, wherein a further alternative form of the binder of the present invention, which is particularly adapted for fabrication from molded plastic parts, is shown and generally designated as 10''. To facilitate reference to these drawing figures and the following description thereof, elements of binder 10'', which correspond to elements of binder 10 are designated by like double primed numbers.

As in the previously described constructions of the present binder, binder 10'' comprises a stationary frame 12'; a gate 14''; and an operating slide member 16''. Further, frame 12'' includes a base 18'' having first and second side portions 18*a''* and 18*b''* arranged to upstand from a connecting flange 18*c''*; and a plurality of stationary claw or ring halves 20'' supported by first side portion 18*a''*. First side portion 18*a''* differs, however, from previously described like elements in that it is defined by a plurality of groups of coplanar leg flanges 70, which upstand from a first lengthwise extending marginal edge of connecting portion 18*c''*; the upper ends of the leg flanges of each group being interconnected by a transversely extending upper flange 72, which is disposed essentially parallel to connecting portion 18*c''* and joined tg the lower ends of mounting end portions 20*b''* of stationary claw halves 20''. Upper flanges 72 are each provided with at least one mounting slot 72*a*, which permit assembly of gate 14'' in the manner to be described. It will be understood that upper flanges 72 are similar in function to assembly tabs 22 and 22' in that they assist in positionally locating slide member 16'' within base 18''.

Second side portion 18*b''* also differs from previously described like elements in that it is defined by a discontinuous flange 74, which upstands intermediate the marginal edges of base connecting portion 18*c''* and has its upper edge joined to the inwardly disposed edges of upper flanges 72. Flange 74 is rendered discontinuous by cutouts 76, which are arranged in alignment and extend essentially coextensive with each of leg flanges 70 in order to facilitate mold forming of frame 12'' in the manner to be described, and by hinge slots or cutouts 78, which are arranged in alignment with mounting slots 72*a* and are in turn bridged by hinge bars or mounting tabs 80, which functionally correspond to mounting tabs 26 and 26'. Each of hinge bars 80 may be characterized as having a lengthwise extending vertical outer surface 80*a*, which is disposed essentially coplanar with the second marginal edge of connecting portion 18*c'*; an arcuate inner or bearing surface 80*b* extending coextensive with an associated hinge slot 78; and pairs of planar upper and lower surfaces 80*c* and 80*d*, which extend from adjacent opposite sides of inner surface 80*b* to the adjacent opposite ends of the hinge bar. It will be understood that hinge bars 80, and particularly arcuate surfaces 80*b*, cooperate with their associated hinge slots 78 to define stationary hinge parts 24''.

Frame 12'' also differs from previously described constructions in the manner in which binder cover 62'' is attached to base connecting portion 18*c''*. More specifically, opposite ends of connecting portion 18*c''* are integrally formed with depending cover retaining devices or clips 86 and 86, which are particularly adapted to permit attachment of a very thin or sheet-like cover, such as may be defined by paper stock of the type used in forming manila folders. By reference particularly to FIGS. 7, 9, 10 and 11, it will be understood that retaining devices 86 and 86 define facing slot openings 88 and 88, wherein each of such openings is vertically bisected by a V-shaped wedge 90. Cover 62'' may be removably fixed to frame 12'' by first slidably inserting its relatively upper and lower or opposite marginal edges within slots 88 and 88, as illustrated in the case of lower marginal edge 62*a* in FIG. 9, until such edges engage with the apexes of wedges 90. Portions of the cover on opposite sides of the retaining devices are then gripped and the inserted edges drawn or forced downwardly over the wedges in directions extending relatively towards the ends of frame 12'', such as to effect deformation of the edges of the cover and resultant frictional locking thereof within retaining devices 86 and 86 in the manner indicated in FIGS. 9–11.

Gate 14'' is also similar to previously described like elements in that it generally includes a connecting portion 30'' and a plurality of movable or second claw or ring halves 32'', wherein the connecting portion is provided with a plurality of movable hinge parts 34'', which cooperate one with each of hinge parts 24'' to support the gate on second side portion 18*b''* for movement between the binder closed and open positions shown in full and broken line in FIG. 11, respectively.

Connecting portion 30″ differs from previously described like elements in that it is in the form of a single bar of generally square cross-sectional configuration having outer, inner, upper and lower surfaces 94*a*–94*d*, respectively, wherein the bar is provided with spaced enlarged portions 96, which are received within hinge slots 78 and serve to define both hinge parts 34″ and cam follower tabs 48″. In this construction, hinge parts 34″ each include a concave bearing surface 98*a*, which functionally corresponds to bearing edge surfaces 38 and 38′, and is sized to slidably engage with arcuate surface 80*b*. Remaining portions of the outer surfaces of enlarged portions 96, which vertically bound bearing surface 98*a*, are disposed in a coplanar relationship with gate connecting portion surface 94*a* and the inner surfaces 98*b* of such enlarged portions are convex and disposed concentrically of the bearing surface. It will be understood that convex surfaces 98*b* functionally correspond to edge surfaces 30*e* and 30*e*′ of the previously described binder constructions, and that sliding previously described binder constructions, and that sliding engagement of the end surfaces of enlarged portions 96 with end surfaces of flange 74 bounding cutouts 76 serves to maintain claw halves 32″ in cooperative alignment with claw halves 20″.

Figures 7, 8, 9:
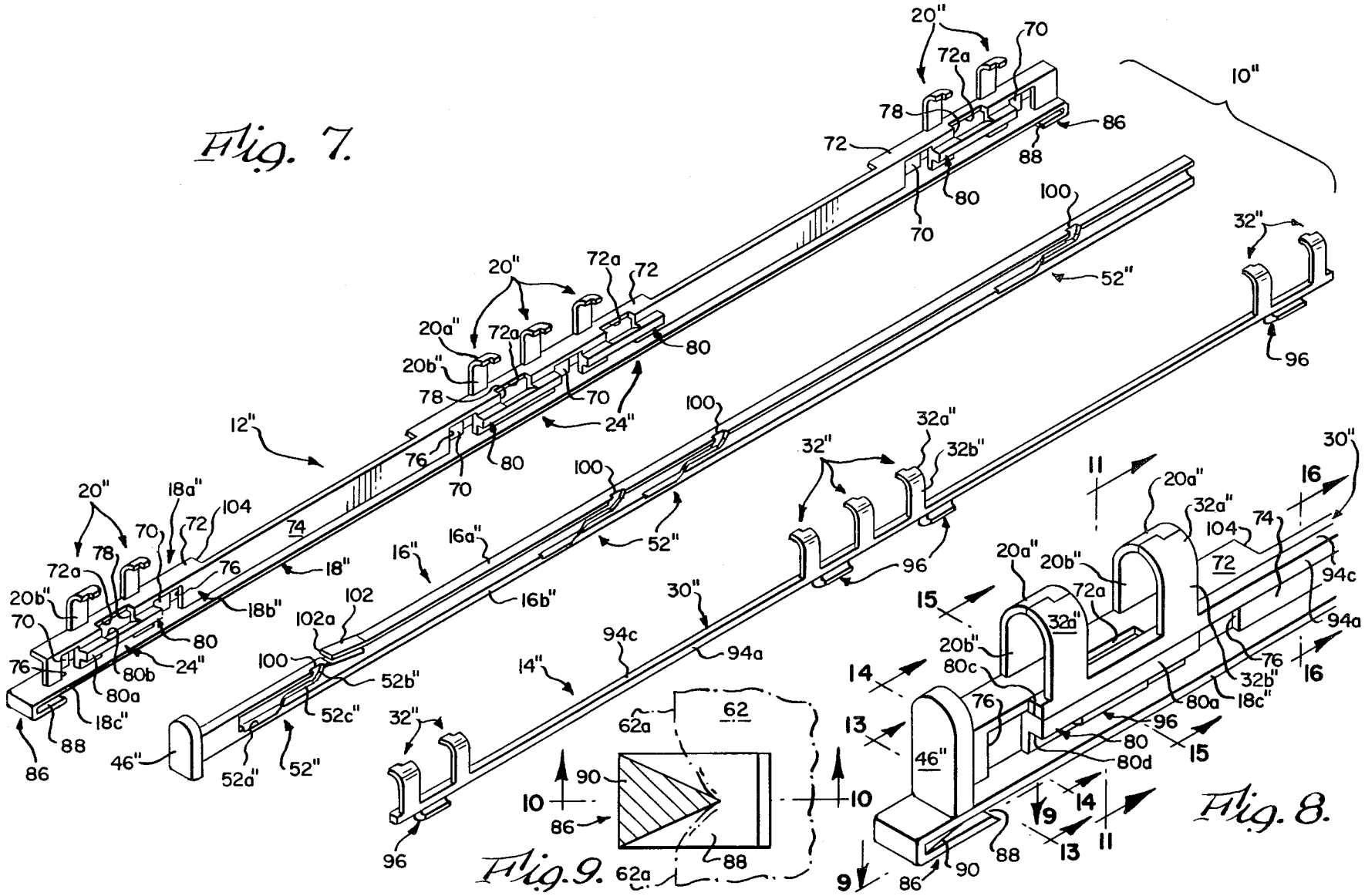
FIG. 7 is an exploded perspective view similar to FIG. 1, but showing a preferred construction, when the binder of the present invention is to be fabricated from molded plastic parts.
FIG. 8 is a fragmentary perspective view of the binder of FIG. 6 in an assembled and closed condition.
FIG. 9 is a sectional view taken generally along the line 9—9 in FIG. 8.

Operating slide member 16″ is best shown in FIGS. 7, 11 and 12 as including cam and base portions 16*a*″ and 16*b*″ having free edge portions 16*c*″ and 16*d*″, respectively, wherein cam portion 16*a*″ is provided with cam slots 52″ sized to receive follower tabs 48″ and has its inner concave surface arranged to slidably engage with the convex surfaces 98*b* of enlargements 96. Slide member 16″ differs in construction from like elements previously described in that free edge portion 16*c*″ is provided with vertically opening assembly passages 100 communicating with upper cam slot portions 52*b*″ and at least one resiliently deformable, cantilever mounted locking flange 102. It will be understood by referring to FIG. 7, that locking flange 102 is formed such that its free end 102*a* is raised above free edge portion 16*c*″, but is resiliently deformable to lie flush with such edge portion.

The mode of assembling binder 10″ differs from that of the previously described binder construction. Specifically, in assembling binder 10″, slide member 16″ is required to be inserted lengthwise within frame base 18″, that is, into the left hand end of the frame base as viewed in FIG. 7, and positioned to align assembly passages 100 with hinge slots 80*b*. As an incident to the insertion of slide member 16″, locking flange 102 is brought into underlying camming engagement with upper flange 72 and thereby caused to be resiliently deformed to lie flush with the surface of free edge portion 16*c*″. Thereafter, gate 14″ is assembled by inserting enlargements 96 within hinge slots 78 to position their bearing surfaces 98*a* for engagement with bearing surfaces 80*b* and adjusting slide member 16″ as required to align assembly passages 100 for receipt of follower tabs 48″. Gate 14″ is then rotated in a counter-clockwise sense, as viewed in FIG. 11, in order to move follower tabs 48″ downwardly within the assembly passages 100 until the former are fully seated within upper cam slots 52*b*″. After this has been accomplished, assembly is completed by imparting a slight further inserting movement to slide member 16″, such as will permit locking flange 102 to move from underlying engagement with upper flange 72 and permit same to resiliently return to its as formed condition, whereupon its free end 102*a* will be positioned to abut against the inner end 104 of upper flange 72 to releasably lock binder 10″ in assembled condition. Assembly passages 100, locking flange 102*a* and upper flange inner end 104 are arranged such that the follower tabs are fully and operably positioned with upper cam slots 52*b*″, as shown in the case of the follower tab designated as 48*a*″ in FIG. 12, when locking flange 102 is disposed for end abutting engagement with upper flange 72 in order to prevent subsequent unintentional realignment of the follower tabs with the assembly passages.

A particularly important feature of the molded plastic binder construction described above in reference to FIGS. 7–16 is that frame 12″, gate 14″ and slide member 16″ are formed such that all of their surfaces are arranged to permit fabrication of each of these elements within a two part die or mold having a single axis of draw. In this connection, it will be apparent that all of the surfaces of the frame, gate and slide member are either disposed essentially parallel to a draw axis extending horizontally transversely of these elements, as viewed in FIGS. 11 and 13–16, as for example would be the case of the upper and lower surfaces of connecting portion 18*c*″ and upper flange 72 of the frame, upper surface 94*c* and lower surface 94*d* of the gate and the upper surface of free edge portion 16*c*″ and the lower surface of base portion 16*b*″ of the slide member; or are fully visible when viewed from either direction along such draw axis, as for example would be the case of the outer and inne surfaces of claw halves 20″, leg flanges 70 and discontinuous flange 74 of the frame, the outer and inner surface of claw halves 32 and surfaces 94*a*, 98*a*, 94*b* and 98*b* of the gate, and the planar outer and concave inner surfaces of the slide member. It will be understood that the term "essentially parallel" is intended to include surfaces, which are actually parallel to such axis, as well as surfaces which are intentionally sloped relatively thereto in order to facilitate separation of the elements from the mold subsequent to the forming operation.

In the foregoing description and appended claims certain terms denoting orientation, such as upper and lower, have been used to facilitate the description of the drawings and understanding of the invention. It is not intended, however, that such terms be considered as limiting in regard to the scope of the present invention, as claimed.

What is claimed is:

1. In a loose leaf binder construction, the combination comprising:

a frame including an elongated base and a plurality of stationary claw halves, said base having first and second opposite side portions upstanding from a connecting portion, said stationary claw halves are joined to upstand from said first of said side portions and said second of said side portions defines stationary hinge means;

a gate including an elongated gate connecting portion and a plurality of movable claw halves joined to upstand from said gate connecting portion, said gate connecting portion having movable hinge means cooperating with said stationary hinge means for supporting said gate for swinging movement between closed and open positions, wherein free ends of said movable claw halves are positioned adjacent to and removed from adjacent free ends of said stationary claw halves, respectively; and an elongated operating slide member supported for sliding movements lengthwise within said base, said slide member and said gate connecting portion defining cooperating cam and cam follower means for controlling swinging movement of said gate between said closed and open positions incident to oppositely directed sliding movements of said slide member lengthwise of said base.

2. A binder construction according to claim 1, wherein said first and second side portions have oppositely facing outer surfaces, said stationary claw halves have mounting end portions whose outwardly facing surfaces are disposed essentially coplanar with said outer surface of said first side portion; said movable claw halves have mounting end portions whose outwardly facing surfaces are disposed essentially coplanar with an outer surface of said gate connecting portion; and said outer surface of said gate connecting portion is disposed essentially coplanar with said outer surface of said second side portion when said gate is disposed in said closed position.

3. A binder construction according to claim 2, wherein said outer surfaces of said first and second side portions are disposed essentially coplanar with opposite lengthwise extending marginal edges of said base connecting portion and define the maximum widthwise dimension cf said binder.

4. A binder construction according to claim 1, 2 or 3, wherein said slide member is provided with a plurality of cam slots spaced apart lengthwise thereof and said gate connecting portion is formed with a plurality of integrally formed cam follower tabs slidably received one within each of said cam slots.

5. A binder construction according to claim 1, 2 or 3, wherein said frame, said gate and said slide member are each of integrally formed one piece construction.

6. A binder construction according to claim 1, wherein said stationary hinge means includes a mounting tab; said slide member includes a concave surface; said gate connecting portion includes oppositely facing bearing surface means including one surface means defining said movable hinge means and disposed for bearing engagement with said mounting tab and another surface means disposed for sliding engagement with said concave surface; and said cam and cam follower means includes at least one cam slot opening through said concave surface and at least one cam follower tab slidably received within said cam slot, and said cam follower tab projects from said other surface means.

7. A binder construction according to claim 6, wherein said first and second side portions have oppositely facing outer surfaces, said stationary claw halves have mounting end portions whose outwardly facing surfaces are disposed essentially coplanar with said outer surface of said first side portion; said movable claw halves have mounting end portions whose outwardly facing surfaces are disposed essentially coplanar with an outer surface of said gate connecting portion; and said outer surface of said gate connecting portion is disposed essentially coplanar with said outer surface of said second side portion when said gate is disposed in said closed position.

8. A binder construction according to claim 7, wherein said outer surfaces of said first and second side portions are disposed essentially coplanar with opposite lengthwise extending marginal edges of said base connecting portion and define the maximum widthwise dimension of said binder.

9. A binder construction according to claim 6, 7, or 8, wherein said frame, said gate and said slide member are each of integrally formed one piece construction.

10. A binder construction according to claim 6, wherein said gate connecting portion includes angularly related and elongated first and second flanges, said second flange is joined to said movable claw halves, said first flange is joined along one edge thereof to said second flange and has an opposite edge defining said other surface means, said movable hinge means includes a clearance opening formed in said second flange adjacent said first flange for receiving said mounting tab and defining said one surface means.

11. A binder construction according to claim 10, wherein said stationary hinge means additionally includes a hinge slot formed in said mounting tab, and said movable hinge means additionally includes a hinge tab projecting from said one surface means and received within said hinge slot.

12. A binder construction according to claim 10, wherein said mounting tab is bent inwardly of said second side portion to overlie said base connecting portion, and said first flange engages with said mounting tab to define said open position of said gate.

13. A binder construction according to claim 6, wherein said mounting tab defines a convex bearing surface facing inwardly of said second side portion, said one surface means is concave and slidably engages with said convex bearing surface, and said other bearing surface means is convex and slidably engages with said concave surface.

14. A binder construction according to claim 1, wherein said gate connecting portion includes elongated, angularly related first and second flanges, said second flange is joined along one edge thereof to said movable claw halves, said first flange is integrally joined along one edge thereof to and opposite edge of said second flange and has an opposite edge thereof cooperating with said slide member to define said cam and cam follower means, said stationary hinge means includes a mounting tab upstanding from said second side portion, said movable hinge means includes a clearance opening formed in said second flange adjacent said first flange for receiving said mounting tab and defining a bearing edge surface on said first flange, said bearing edge surface engaging with a relatively inner surface of said mounting tab to define a fulcrum about which said gate swings between said open and closed positions.

15. A binder construction according to claim 14, wherein said base has a U-shaped cross-sectional configuration and is provided with assembly means deformable to overlie said base connecting portion; said slide member is defined by first and second elongated flange members, said first flange member having a convex surface arranged to slidably engage with a relatively inner surface of said first side portion, a concave surface arranged to face towards a relatively inner surface of said second side portion and an upper edge portion arranged to slidably engage with said assembly means, said second flange member is joined to said first flange member remotely of said upper edge portion and extends therefrom transversely of said base, said second flange member having a free end portion arranged to slidably engage with said inner surface of said second side portion and an inner surface of said base connecting portion adjacent the juncture thereof, said cam and said cam follower means includes at least one cam follower tab projecting from said opposite edge of said first flange and at least one cam slot opening through said concave surface and slidably receiving said follower tab, and said opposite edge of said first flange is arranged to slidably engage with said concave surface.

16. A binder construction according to claim 15, wherein said first and second side portions have parallel oppositely facing outer surfaces, said stationary claw halves have mounting end portions joined to said first side portion and having outwardly facing surfaces disposed essentially coplanar with said outer surface of said first side portion, said movable claw halves have mounting end portions joined to said second flange and having outwardly facing surfaces disposed essentially coplanar with an outer surface of said second flange, and said outer surface of said second flange is disposed essentially coplanar with said outer surface of said second side portion when said gate is disposed in said closed position.

17. A binder construction according to claim 16, wherein said frame, said gate and said slide member are each of an integrally formed one piece construction.

18. A binder construction according to claim 14, 15, 16 or 17, wherein said stationary hinge means additionally includes a hinge slot formed in said mounting tab, and said movable hinge means additionally includes a hinge tab projecting from said bearing edge surface and received within said hinge slot.

19. A binder construction according to claim 14, 15, 16 or 17, wherein said mounting tab is bent inwardly of said second side portion to overlie said base connecting portion, and said first flange engages with said mounting tab to define said open position of said gate.

20. A binder construction according to claim 15, wherein the combination additionally comprises a cover arranged for engagement with an outer surface of said base connecting portion, said cover and said base connecting portion are provided with aligned openings for receiving means for attaching said cover to said base connecting portion, and said free end portion is bent do:;nwardly for maintaining said second flange member in a spaced relationship from said inner surface of said base connecting portion.

21. A binder construction according to claim 1, wherein said stationary hinge means includes a convex bearing surface facing inwardly of said base, and said movable hinge means includes a concave bearing surface slidably engageable with said convex bearing surface.

22. A binder construction according to claim 21, wherein said slide member includes a concave surface facing towards said convex bearing surface, said gate connecting portion has a convex surface disposed concentrically of said concave bearing surface thereof, said convex surface is disposed for sliding engagement with said concave surface, and said cam and cam follower means includes a cam slot opening through said concave surface and cam follower tab projecting from said convex surface for receipt within said cam slot.

23. A binder construction according to claim 22, wherein said first and second side portions having outer surfaces disposed essentially parallel and coplanar with oppositely disposed lengthwise extending marginal edges of said base connecting portion, and said gate connecting portion has an outwardly facing surface thereof disposed essentially coplanar with said outer surface of said second side portion when said gate is in said closed position.

24. A binder construction according to claim 1, wherein said base connecting portion has a pair of integrally formed retaining devices arranged to depend from adjacent opposite ends thereof for removably attaching a sheet-like cover to said base by deformable engagement with opposite marginal edges of said cover.

25. A binder construction according to claim 24, wherein said retaining devices define facing slot openings for slidably receiving said opposite marginal edges and V-shaped wedges arranged to vertically bisect said slot openings for deforming said opposite marginal edges incident to insertion thereof within said slot openings.

26. A binder construction according to claim 1, wherein said second side portion includes a flange upstanding from said base connecting portion and having an opening extending therethrough and a bar bridging said opening between adjacent portions of said flange, said bar having an inwardly facing convex bearing surface defining said stationary hinge means, said gate connecting portion is provided with an enlarged portion sized to be received within said opening, said movable hinge means includes a concave bearing surface defined by said enlarged portion and arranged for sliding engagement with said convex bearing surface to support said gate for movement between said closed and open positions, and said enlarged portion cooperates with said slide member to define said cam and cam follower means.

27. A binder construction according to claim 26, wherein said enlarged portion has a convex surface disposed concentrically of said concave bearing surface, said slide member has a concave surface arranged for slidable engagement with said convex surface, and said cam and cam follower means includes a cam slot opening through said concave surface and a cam follower tab projecting from said convex surface for receipt within said cam slot.

28. A binder construction according to claim 27, wherein said first side portion includes an upper flange joined to said flange and disposed in a spaced relationship to said base connecting portion, said slide member has an upper surface arranged to underlie said upper flange and an assembly passage extending from said upper surface thereof into communication with said cam slot for permitting insertion of said follower tab into said cam slot, and said slide member includes resiliently deformable means cooperating with said upper flange for preventing removal of said follower tab from within said cam slot through said assembly passage.

29. A binder construction according to claim 28, wherein said frame, said gate and said slide member are each of one piece molded plastic construction.

30. A binder construction according to claim 28, wherein said free ends of said stationary and movable claw halves are curved and joined to said first side portion and said gate connecting portion by straight mounting ends having oppositely facing outer surfaces, said outer surface of said mounting end of said stationary claw halves being essentially coplanar with an outwardly facing surface of said first side portion and one lengthwise extending marginal edge of said base connecting portion, said outer surface of said mounting end of said movable claw halves being essentially coplanar with an outwardly facing surface of said gate connecting portion including portions of said enlarged portion bounding said concave bearing surface, which in turn lie essentially coplanar with an outer surface of said bar and an opposite lengthwise extending marginal edge of said base connecting portion when said gate is in closed condition, and the distance between said outer surfaces of said first side portion and said bar determines the maximum widthwise dimension of said binder when said gate is in said closed condition.

31. A binder construction according to claim 28, 29, or 30, wherein said base connecting portion has a pair of integrally formed retaining devices arranged to depend from adjacent opposite ends thereof for removably attaching a sheetlike cover to underlie said base connecting portion by deformable engagement with opposite marginal edges of said cover, said retaining devices define facing slot openings for slidably receiving said opposite marginal edges and V-shaped wedges arranged to vertically bisect said slot openings for deforming said opposite marginal edges incident to insertion thereof within said slot openings.

32. A binder construction according to claim 6, 7 or 8, wherein said frame, said gate and said slide member are each of integrally formed one piece molded plastic construction, characterized in that each of said frame, said gate and said slide member has the respective surfaces thereof arranged to permit same to be formed in a two part mold having a single axis of draw.

33. A binder construction according to claim 6, 7 or 8, wherein said frame, said gate and said slide member are each of integrally formed one piece molded plastic construction, characterized in that each of said frame, said gate and said slide member has its respective surfaces arranged either essentially parallel to a single axis extending transversely thereof or are fully visible when viewed from either direction along said axis.

* * * * *

UNITED STATES PATENT AND TRADEMARK OFFICE

CERTIFICATE OF CORRECTION

PATENT NO. : 4,486,112

DATED : December 4, 1984

INVENTOR(S) : Richard D. Cummins

It is certified that error appears in the above-identified patent and that said Letters Patent are hereby corrected as shown below:

Col. 2, line 49 - "18i a" should be --18a--.

Col. 5, line 27 - the first comma (,) should be deleted.

Col. 6, line 2 - "tg" should be --to--.

Col. 6, line 27 - "18c'" should be --18c"--.

Col. 7, lines 20 and 21 - "and that sliding previously described binder constructions," should be deleted.

Col. 8, line 30 - "inne" should be --inner--.

Col. 11, line 41 - "do:;nwardly" should be --downwardly--.

Signed and Sealed this

*Twenty-first* Day of *May 1985*

[SEAL]

*Attest:*

DONALD J. QUIGG

*Attesting Officer* *Acting Commissioner of Patents and Trademarks*